US006062424A

United States Patent [19]

Simile-Gravina et al.

[11] Patent Number: 6,062,424

[45] Date of Patent: May 16, 2000

[54] CONVERTIBLE PACKAGE DISPENSER

[75] Inventors: Nicolina C. Simile-Gravina, Burlington; Lesley S. Rodenhiser, Mississauga; Alissa F. Podheiser, Toronto, all of Canada

[73] Assignee: Smithkline Beecham Corporation, Philadelphia, Pa.

[21] Appl. No.: 08/844,223

[22] Filed: Apr. 18, 1997

[51] Int. Cl.[7] ..... A47F 1/04

[52] U.S. Cl. ..... 221/305; 221/309; 221/155; 229/122.1; 206/746; 206/774

[58] Field of Search ..... 221/155, 305, 221/307, 309; 229/122.1, 120.011, 121, 122; 206/746, 774, 499

[56] References Cited

U.S. PATENT DOCUMENTS

| | | | |
|---|---|---|---|
| 2,706,066 | 4/1955 | Wells | 229/121 |
| 2,888,132 | 5/1959 | Guyer | 206/264 |
| 2,891,711 | 6/1959 | Early | 229/221 |
| 3,209,941 | 10/1965 | Krake | 221/48 |
| 3,300,115 | 1/1967 | Schauer | 221/305 |
| 3,332,594 | 7/1967 | De Capua | 221/309 |
| 3,568,911 | 3/1971 | Bebout | 221/305 |
| 4,739,922 | 4/1988 | Zimmermann | 221/305 |
| 4,961,501 | 10/1990 | Hansmann | 206/429 |

FOREIGN PATENT DOCUMENTS

| | | | |
|---|---|---|---|
| 1016522 | 11/1952 | France | 221/45 |

OTHER PUBLICATIONS

Color photocopy of photograph of "Claritin"® package dispenser (1 Sheet).

Color photocopy of photograph of "Pepcid ac"® package dispenser (1 Sheet).

Color photographs (9 total photographs) of Tagamet® dispenser, SmithKline Beecham, Philadelphia, PA 1995 (3 sheets).

*Primary Examiner*—David A. Bucci
*Assistant Examiner*—Thuy V. Tran
*Attorney, Agent, or Firm*—Panitch Schwarze Jacobs & Nadel, P.C.

[57] ABSTRACT

A convertible package dispenser to dispense a plurality of identical, smaller packages, is provided by a parallelepiped carton having hollow interior sized to receive the plurality of packages arranged in a row. The carton is formed by first and second pairs of opposing, rectangular longitudinal walls and one pair of opposing end walls smaller in size than the longitudinal walls. First slot openings are provided in each of the longitudinal walls of the first pair proximal one of the end walls in order to remove packages from the carton. Another slot opening is provided through such longitudinal walls proximal an opposing longitudinal end of the wall to insert packages that were removed. Removable covers in the form of removable tab elements are provided over the slot openings to retain the packages within the carton until the carton is set up to dispense packages. The carton can be stood upright on one or either of the end walls, depending upon the location of the slot openings, to use the carton as a merchandize tower dispenser. Preferably, the two longitudinal walls with slot openings are printed with indicia in two different languages so that either side may be selected for use to dispense packages. In addition, cuts, cut-outs, lines of perforation or other lines/areas of weakness are provided extending through the pair of end walls and the second pair of longitudinal walls entirely around the carton so that the carton may be broken into two halves and one of the two halves used as a flat, dispenser tray. Preferably there is printed text in different languages on either end wall so that either end wall may be used as the front wall of the tray depending upon the language desired to be exhibited on the front of the tray.

11 Claims, 5 Drawing Sheets

CONVERTIBLE PACKAGE DISPENSER

BACKGROUND OF THE INVENTION

Businesses are constantly seeking ways to better present their products to the purchasing public. For example, manufacturers of packaged goods sold at retail often favor upright displays of their products or product information in retail outlets for the greater presence and impact made by such displays on purchasers and potential purchasers. This preference sometimes carries over to individual devices used to hold and dispense packages for retail sale. Distributors of novelty items, which often do not have access to shelf space, have long distributed their products by mounting them to placards which may be hung vertically wherever convenient. More recently, in some retail markets, three dimensional dispenser "towers", which may be from less than a foot to well over a foot in height, have been used to hold and dispense small individual packages for retail sale. These towers have sufficient size to carry large printing and graphics for easy reading and strong aisle presence.

One problem with the use of such towers is that shelf space of a sufficient height may not be available to enable the towers to be installed on shelves in their normal, upright orientation. Existing towers are therefore generally supplied with hooks or loops to receive hooks so they may be hung from their rear side on the front of a shelf or from some other support. Such towers are normally designed to gravity feed individual packages within the tower through a relatively small dispensing opening at the bottom of the tower. If shelf height is limited or if the retailer wishes to have the product placed on its shelves near other competitive products for the convenience of shoppers, the tower may have to be placed on a shelf on its side or back or the individual packages may have to be removed from the tower and positioned loose on the shelf. If such towers have to be positioned on their side or back, not only are the advantages of such towers lost, their construction may become a hindrance and annoyance to consumers who have difficulty in attempting to remove individual packages from such devices. If individual packages have to be removed and the towers discarded due to limited shelf height, all potential marketing advantages from such devices are lost and the extra costs that their manufacture entailed are wasted.

BRIEF SUMMARY OF THE INVENTION

The invention is a convertible package dispenser comprising a parallelepiped carton having a hollow interior sized to receive a plurality of packages to be dispensed, the carton being formed by first and second pairs of opposing longitudinal walls each rectangular in shape and one pair of opposing end walls, each end wall being smaller in size than each of the longitudinal walls, each of the longitudinal walls of the first pair having a width dimension and a length dimension greater than the width dimension and a slot opening extending at least entirely across the width dimension, each slot opening being located proximal a longitudinal end of the longitudinal wall bearing the slot opening, a selectively removable cover element on each longitudinal wall of the first pair extending at least partially over the slot opening so as to prevent removal of any packages from the hollow interior of the carton through the slot opening while the cover element remains in place, and separation means for permitting selective removal of at least enough of one of the longitudinal walls of the first pair to convert the carton into an open top tray capable of retaining the plurality of packages for dispensation.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings, which are diagrammatic.

DETAILED DESCRIPTION OF THE INVENTION

Figure 1:
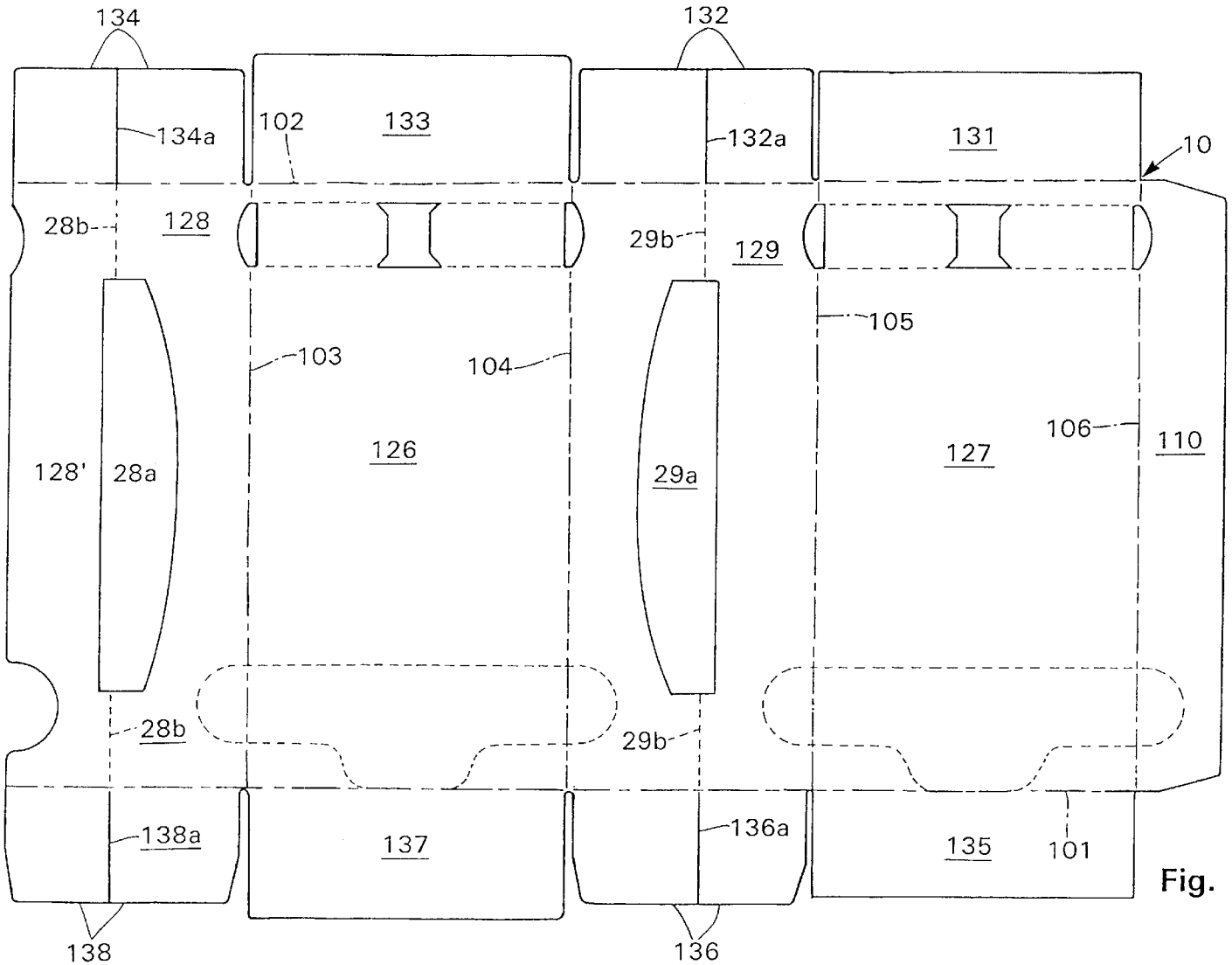
FIG. 1 is a front view of a board stock blank used to make the preferred embodiment dispenser seen in the following views.

In the drawings, like numerals are used to indicate like elements throughout. FIG. 1 depicts a blank 10 of conventional board stock used to form the convertible package dispenser of the present invention. The blank 10 is folded along broken lines 101–106 and the overlapping longitudinal side panel portions 110, 128' and the overlapping end panel portions 131–134 and 135–138 are joined together by suitable means such as adhesives.

Figure 2:
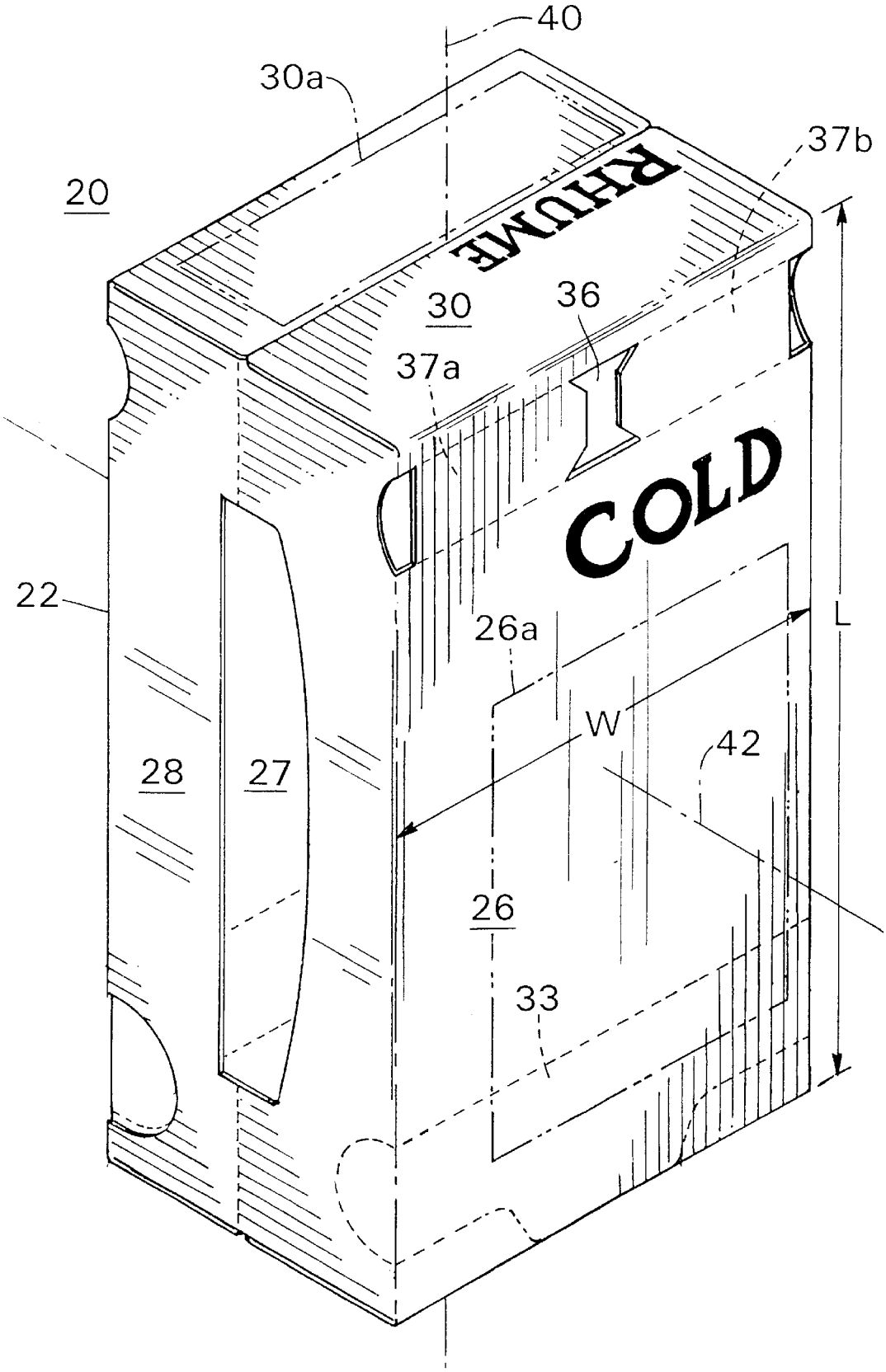
FIG. 2 is a perspective view of the assembled convertible package dispenser of the present invention in an upright, "merchandising tower" configuration showing three of its six sides.
Figure 3:
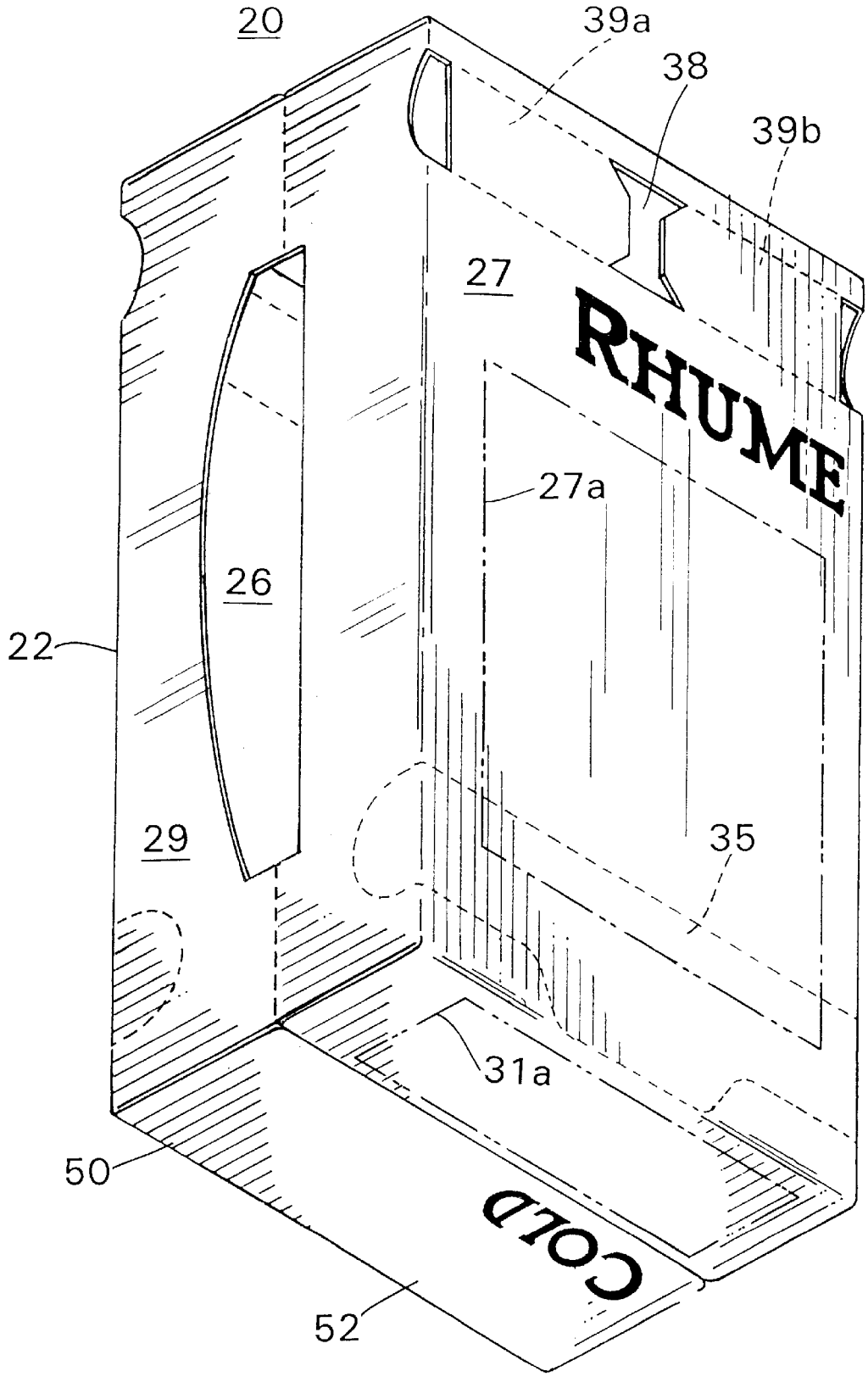
FIG. 3 is a perspective view of the tower dispenser of FIG. 2 showing the remaining three sides.

FIGS. 2 and 3 show the convertible package dispenser 20 formed from the blank 10 of FIG. 1. The original form of the dispenser 20 is a parallelepiped carton 22 having a hollow interior sized to received a plurality of individual packages 24 (in phantom in FIG. 4) to be dispensed. The carton 22 is formed by first and second pairs of opposing longitudinal walls each rectangular in shape. First walls 26 and 28 of the first and second pairs of longitudinal walls are seen in FIG. 2. The opposing, second longitudinal walls 27 and 29 of the first and second pairs, respectively, are seen in FIG. 3. The carton 22 further includes a pair of opposing end walls 30 and 31, seen in FIGS. 2 and 3, respectively. The end walls 30, 31 may be square or rectangular, depending upon the size of the packages 24 contained in the carton 22, but are smaller in size than each of the longitudinal walls 26–29.

Referring to FIG. 2 and specifically to the first longitudinal wall 26 of the first pair as an example, each longitudinal wall has a width dimension "W" and a length dimension "L", which is greater than the width dimension W. Each of the longitudinal walls 26 and 27 of the first pair also includes a slot opening 32 and 34, respectively, seen only in FIG. 4. Each slot opening 32, 34 is identical and extends at least entirely across the width dimension W of the longitudinal wall 26, 27 respectively bearing the slot opening 32, 34. According to the invention, each slot opening is located proximal one of the end walls. More particularly, in the indicated preferred embodiment 20, each slot opening 32, 34 is located proximal to the same end wall, namely the second end wall 31, which becomes the bottom wall of the dispenser 20 when the dispenser is used in an upright, "merchandising tower" configuration shown in FIGS. 2 through 4. However, the slot openings 32, 34 could have been positioned on the separate longitudinal walls 26, 27 to adjoin different end walls. In that case, either one of the end walls 30, 31 could become the bottom wall of the tower dispenser, depending upon which of the first pair longitudinal walls 26, 27 is used as the front wall of the tower.

Also according to the invention, a selectively removal cover element 33, 35, is provided on each of the longitudinal walls 26, 27, respectively, of the first pair extending at least partially and, preferably entirely over the respective slot opening 32, 34 so as to prevent removal of any of the packages 24 from the hollow interior of the carton 22 while the cover element 33, 35 remains in place on the respective longitudinal wall 26, 27. Preferably, each of the slot openings 32, 34 extends into one or both of the longitudinal walls 28 and 29 of the remaining, second pair. This permits packages 24 within the carton 22 to be more easily grasped for removal. Each slot opening 32, 34 has a height dimension in the longitudinal direction of its wall 26, 27, respectively, with cover element 33, 35 removed, sufficient to permit passage of only one of the packages 24 at a time through the slot opening 32, 34.

Figure 4:
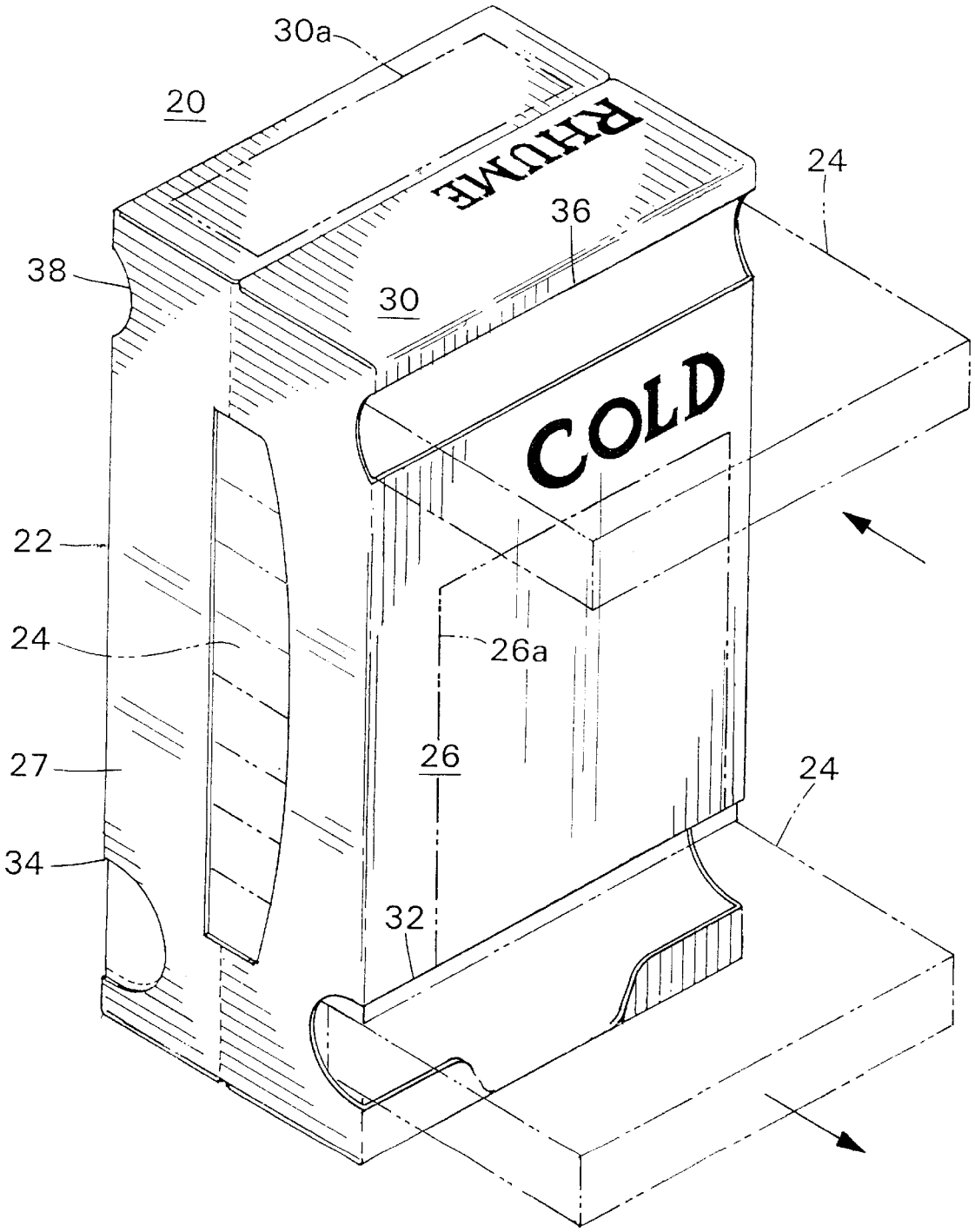
FIG. 4 is a perspective view of the tower dispenser of FIGS. 2 and 3 showing the dispensation and return of individual packages from and into the hollow interior of the tower dispenser.

Preferably, each of the longitudinal walls 26, 27 of the first pair has another slot opening 36, 38 extending entirely across the width dimension W of the respective longitudinal walls 26, 27. The other slot opening 36, 38 is located proximal an opposing longitudinal end of the longitudinal wall 26, 27 bearing the original slot opening 32, 34. The other slot opening 36, 38 has a height sufficient to permit the insertion of packages 24 one at a time into the carton 22 as shown in FIG. 4. Each of the longitudinal walls 26, 27 of the first pair further includes yet another selectively removable cover element extending over at least part of the other slot opening 36, 38. In the preferred embodiment depicted in FIGS. 2 and 3, pairs of removal cover elements 37*a*, 37*b* and 39*a*, 39*b* are provided extending over parts of the respective other slot openings 36 and 38. Again, slot openings 36, 38 and their removal covers 37*a*, 37*b* and 39*a*, 39*b* on both sides 26, 27 of dispenser 20 are identical.

The dispenser carton 22 is preferably filled with a plurality of the packages 24, which preferably are identically sized and have major sides which are only slightly smaller than the size of the end walls 30, 31 of the carton 22. This permits the packages 24 to be arranged in a single row in the hollow interior of the carton 22. Each of the slot openings 32, 34, 36 and 38 has a height across the full width of the respective longitudinal wall 26, 27, with respective cover element(s) 33, 34, 37*a*, 37*b* and 39*a*, 39*b* removed, which is at least as large as the height of one package 24 but less than the height of two packages 24 so as to permit passage of only one of the packages 24 at a time through any of the slot openings 32, 34, 36 and 38. Preferably dispensing slot openings 32 and 34 are further extended down to the proximal carton end wall 31 over a portion of their width to enable the bottom package, which is generally to be the last package 24 to be removed from the carton 22, to be raised for removal through the remainder of the slot 32, 34.

An important aspect of the convertible dispenser 20 is its ability to be printed and used with two different languages. This is becoming increasingly valuable in some countries like Canada, which require bilingual packaging, and in other areas such as the European Common Union, where products are now being distributed in their country of origin, and, increasingly, in other nearby countries having different national languages. Being able to print the dispenser 20 in two languages enables only half as many different dispensers 20 to be needed where there is a need or desire to provide the dispensers in more than one language.

Referring to FIG. 2, at least the first longitudinal wall 26 of the first pair of longitudinal walls 26, 27, has indicia printed in a first language, for example, the English word "COLD" and other English text, which is not depicted but is indicated diagrammatically by phantom area 26*a*. Referring to FIG. 3, the same indicia (COLD) is printed on the second longitudinal wall 27 of the first pair in a second language, for example, French, as the word "RHUME" along with other French text (not depicted) but indicated in phantom area 27*a* corresponding to the English text on wall 26. The bulk of the printing and information to be conveyed is preferably provided on one of the pairs of opposing longitudinal walls, for example the first pair of opposing longitudinal walls 26 and 27, which are selectively used as the front walls of the dispenser 20 when it is used in an upright, merchandising tower configuration shown in FIGS. 2 through 4. End walls 30 and 31 preferably are also printed with identical information in two different languages indicated by phantom areas 30*a*, 31*a* in FIGS. 2 and 3. Preferably, longitudinal walls 26, 27 (and end walls 31 and 30) are printed with language text only in one language (English and French, respectively). Note that a trademark, which may be a common word in one of the two languages but, nevertheless, is used as a trademark in both languages, may appear on each of the walls 26, 27, 30 and/or 31, as well as on remaining walls 28, 29.

Figure 5:
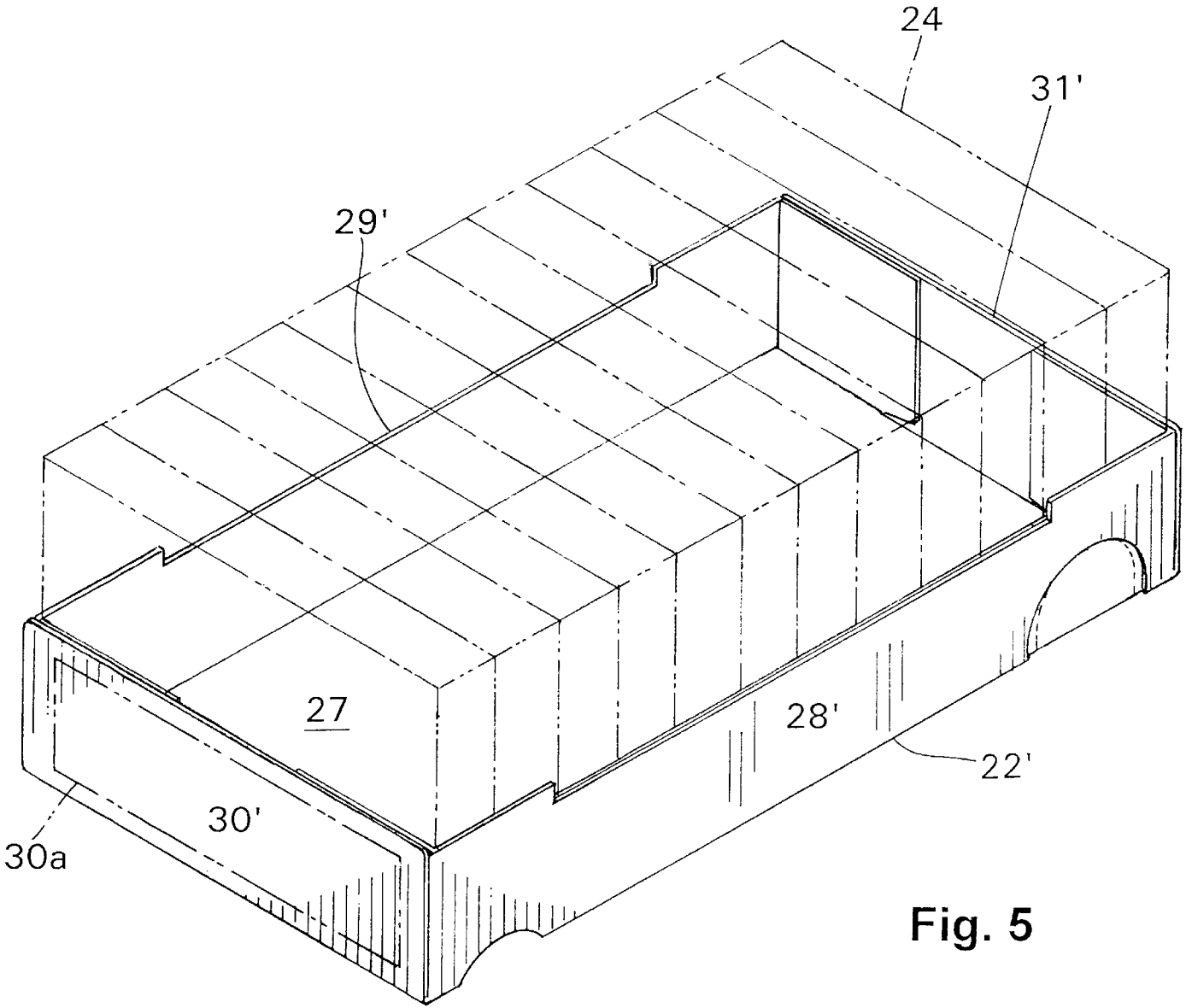
FIG. 5 is a perspective view of the dispenser of FIGS. 2–4 reconfigured as a tray.

Note also that the first pair of longitudinal walls 26 and 27 are rotationally symmetric about a longitudinal axis 40 through the dispenser. That is, rotation of the dispenser 20 one hundred and eighty degrees about the axis 40 presents a new face of the dispenser 20 identical to the first but in a different language. The end walls 30, 31 are rotationally symmetric about a second axis 42 extending transversely through the tower between the first pair of longitudinal walls 26, 27. This latter symmetry is provided because in the preferred dispenser 20 depicted, one longitudinal wall 27 and portions of the remaining pair of longitudinal walls 28, 29 and end walls 30, 31 are retained to form a dispensing tray 22' depicted in FIG. 5. The original carton 22 is convertible into the tray 22' by the provision of separation means in the original blank 10 and/or the original carton 22. The separation means permits selective removal of at least enough of one of the longitudinal wall 26 of the first pair to convert the carton 22 into an open top tray which is capable of retaining the plurality of packages 24 for dispensation. The tray 22' is formed by longitudinal wall 27 and remaining halves 28', 29', 30' and 31' of original walls 28–31.

The separation means may be scoring, which extends completely through or only partially through the thickness of the blank 10, perforations or other lines (or areas) of weakness (or other openings) which are provided in the stock material forming the blank 10. Referring to FIG. 1, for the indicated preferred embodiment dispenser 20, the separation means includes the large scored openings 28*a*, 29*a* in panel portions 128, 129 defining the second pair of longitudinal walls 28, 29, lines of perforations 28*b* on either side of cutout 28*a* and lines of perforations 29*b* on either side of cutout 29*a*. Each of the end walls 30 and 31 is formed by folding over and joining together end panel portions 131–134 and 135–138 extending from the longitudinal panel portions 126–129, which form the longitudinal walls 26–29 respectively of carton 22. The end tab portions 132, 134, 136 and 138 have cuts 132*a*, 134*a*, 136*a* and 138*a*, respectively, which extend along the lengths of the end tab portions of the blank 10 or may be provided with perforations along their length as part of the separation means. Cuts 132*a,* 134*a,* 136*a,* 138*a* are parallel with and located between adjoining edges of end portions 131, 133 and 135, 137, respectively in the assembled carton 22. In this way, the separation means extend entirely across each of the end walls 30, 31 between the second opposing pair of longitudinal walls 28, 29 and along the entire lengths of the second pair of longitudinal walls 28, 29. The scoring (e.g. the slits, cuts, cutouts, lines of perforations, other lines/areas of weakness) preferably permit the removal of one entire longitudinal wall, the first longitudinal wall 26, as well as adjoining portions, namely halves, of each of the other carton walls connected directly with the one longitudinal wall, namely longitudinal walls 28 and 29 and end walls 30 and 31.

Lastly, if desired, one or more friction "feet" of a soft polymer material having a coefficient of friction greater than that of the outside of the carton 22 can be applied to bottom end wall 31 by suitable means such as a pressure sensitive adhesive to limit any tendency of the carton 22 to easily slide about when stood on that end wall 31. Preferably a pair of circular 50, 52 are applied to the portion of end wall 31 which is removed when the carton 22 is converted in to tray 22' to leave the English language text in area 30*a* as visable.

It will be appreciated by those skilled in the art that changes could be made to the embodiments described above without departing from the broad inventive concept thereof. For example, the printing/indicia and other features (e.g. slots 32, 36 and removable cover elements 33, 37*a,* 37*b*) can be inverted between walls 26 and 27 so that the same language is exposed on the front longitudinal wall and upper end wall of the dispenser 20 when configured as a carton 22. More or less of the carton 22 can be made removable by the separation means to convert carton 22 into an open top tray dispenser. The dispenser might be provided in a length of less than a foot so as to be able to conveniently stand the dispenser on end in an upright, tower configuration on shelves. The slot openings and/ or removable covers may have different shapes, locations and numbers. It is understood, therefore, that this invention is not limited to the particular embodiments disclosed, but is intended to cover modifications within the spirit and scope of the present invention as defined by the appended claims.

We claim:

1. A convertible package dispenser comprising a parallelepiped carton having a hollow interior sized to receive a plurality of packages to be dispensed, the carton being formed by first and second pairs of opposing longitudinal walls each rectangular in shape and one pair of opposing end walls, each end wall being smaller in size than each of the longitudinal walls, each of the longitudinal walls of the first pair having a width dimension and a length dimension greater than the width dimension) each of the longitudinal walls of the first pair further having a slot opening extending at least entirely across the width dimension, each slot opening being located proximal a longitudinal end of the longitudinal wall bearing the slot opening, a selectively removable cover element on each longitudinal wall of the first pair extending at least partially over the slot opening so as to prevent removal of any packages from the hollow interior of the carton through the slot opening while the cover element remains in place, and separation means for permitting selective removal of at least enough of one of the longitudinal walls of the first pair to convert the carton into an open top tray capable of retaining the plurality of packages for dispensation.

2. The dispenser of claim 1 wherein the separation means extend across each of the end walls of the one pair so as to permit removal of at least a portion of each of the end walls to form the tray.

3. The dispenser of claim 2 wherein the separation means permits removal of at least a portion of each longitudinal wall of the second pair to form the tray.

4. The dispenser of claim 1 wherein the separation means permits removal of at least a portion of each longitudinal wall of the second pair to form the tray.

5. The dispenser of claim 1 further comprising indicia printed in a first language on a first one of the first pair of longitudinal walls and in a second language different from the first language on a second one of the first pair of longitudinal walls.

6. The dispenser of claim 5 wherein the first one of the first pair of longitudinal walls contains language text only in the first language and wherein the second one of the first pair of longitudinal walls contains language text only in the second language.

7. The dispenser of claim 5 further comprising language indicia in the first language on one end wall of the one pair and in the second language on a remaining end wall of the one pair.

8. The dispenser of claim 1 further comprising language indicia printed in the first language on one end wall of the one pair and a second language different from the first language on a remaining end wall of the one pair.

9. The dispenser of claim 1 wherein the slot opening of each longitudinal wall of the first pair extends into each longitudinal wall of the second pair.

10. The dispenser of claim 1 in combination with the plurality of packages arranged in a row in the hollow interior, each package being parallelepiped in shape and the slot opening in each longitudinal wall of the first pair having a height with the cover element removed sufficient to permit passage of only one of the packages at a time through the slot opening.

11. The dispenser of claim 10, wherein each longitudinal wall of the first pair has another slot opening extending at least entirely across the width dimension of the longitudinal wall, the other slot opening being located proximal an opposing longitudinal end of the longitudinal wall bearing the other slot opening, the other slot opening having a height sufficient to permit insertion of the packages one at a time into the carton, and each longitudinal wall of the first pair further including another selectively removable cover element extending over at least part of the other slot opening.

* * * * *